US007733211B2

(12) United States Patent
Yoneda

(10) Patent No.: US 7,733,211 B2
(45) Date of Patent: Jun. 8, 2010

(54) CHIP RESISTOR AND ITS MANUFACTURING PROCESS

(75) Inventor: Masaki Yoneda, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 250 days.

(21) Appl. No.: 11/922,518

(22) PCT Filed: Jun. 20, 2006

(86) PCT No.: PCT/JP2006/312311

§ 371 (c)(1),
(2), (4) Date: Dec. 19, 2007

(87) PCT Pub. No.: WO2006/137392

PCT Pub. Date: Dec. 28, 2006

(65) Prior Publication Data

US 2009/0237200 A1 Sep. 24, 2009

(30) Foreign Application Priority Data

Jun. 21, 2005 (JP) ..... 2005-180698
Jul. 28, 2005 (JP) ..... 2005-218697

(51) Int. Cl.
*H01C 1/012* (2006.01)

(52) U.S. Cl. ..... 338/307; 338/22 R; 338/195; 29/620

(58) Field of Classification Search ..... 338/195, 338/307–309, 206, 292, 22 R, 293, 283; 340/641–643; 29/610.1, 620
See application file for complete search history.

(56) References Cited

U.S. PATENT DOCUMENTS

| | | | | |
|---|---|---|---|---|
| 3,813,520 | A * | 5/1974 | Brouneus | 219/543 |
| 4,101,820 | A * | 7/1978 | Montanari | 323/369 |
| 5,321,382 | A * | 6/1994 | Mizukoshi et al. | 338/53 |
| 5,493,148 | A * | 2/1996 | Ohata et al. | 257/538 |
| 6,292,091 | B1 * | 9/2001 | Kambara et al. | 338/195 |

FOREIGN PATENT DOCUMENTS

| | | |
|---|---|---|
| JP | 7-74002 | 3/1995 |
| JP | 11-273901 | 10/1999 |
| JP | 2000-216001 | 8/2000 |
| JP | 2001-319829 | 11/2001 |
| JP | 2002-203702 | 7/2002 |
| JP | 2004-79599 | 3/2004 |
| JP | 2006-019694 | 1/2006 |

* cited by examiner

*Primary Examiner*—Kyung Lee
(74) *Attorney, Agent, or Firm*—Hamre, Schumann, Mueller & Larson, P.C.

(57) ABSTRACT

A chip resistor (1) includes a chip substrate (2) a mutually separated terminal electrodes (3, 4) formed on the upper surface of the substrate (2), and a meandering resistor film (5) formed between the two terminal electrodes (3, 4). Each of the terminal electrodes (3, 4) includes an inner edge (3*a*, 4*a*) extending diagonally from one side surface (2*a*) toward the other side surface (2*b*) of the chip substrate (2). Each of the inner edges (3*a*, 4*a*) has a portion closer to the resistor film (5) that is electrically connected to a narrow portion (7, 8) formed integral with the resistor film (5). The narrow portion extends outward from an end (5*a*, 5*b*) of the resistor film (5).

3 Claims, 6 Drawing Sheets

CHIP RESISTOR AND ITS MANUFACTURING PROCESS

TECHNICAL FIELD

The present invention relates to a chip resistor and a method for manufacturing the same.

BACKGROUND ART

Conventionally various types of chip resistors have been proposed. For instance, the Patent Document 1 listed below discloses a chip resistor having a structure as shown in FIG. 9 of the present application. The Patent Documents 2 and 3 disclose a chip resistor having a structure as shown in FIG. 11 of the present application. It should be noted here that the chip resistor shown in FIG. 10 of the present application is not presented as prior art, but as a comparative example only for better understanding of the present invention.

Patent Document 1: JP-A-H11-273901

Patent Document 2: JP-A-2000-216001

Patent Document 3: JP-A-2002-203702

Specifically, the conventional chip resistor R1 shown in FIG. 9 of the present application includes a substrate A1, a resistor film A2 and a pair of terminal electrodes A3 connected to the resistor film A2. The substrate A1 has a predetermined length L and a predetermined width W. The resistor film A2 is formed with a trimming groove A4 for resistance adjustment.

In the chip resistor R1, the single resistor film A2 is provided between the paired terminal electrodes A3. With this arrangement, when a voltage is applied between the paired terminal electrodes A3, current flows only through the resistor film A2. Therefore, when the chip resistor R1 is applied to a circuit for high power supply, the temperature of the resistor film A2 may become excessively high. In such a case, the circuit may fail to operate properly.

This problem may be solved by employing the structure shown in FIG. 10, for example. Specifically, the chip resistor R2 shown in the figure includes a substrate B1, a plurality of resistor films B2 and a pair of terminal electrodes B3. The length L and the width W of the substrate B1 are equal to those of the above-described substrate A1. Each of the terminal electrodes B3 is formed on a longitudinally-extending side surface of the substrate B1. The resistor films B2 are connected in parallel with each other with respect to the paired electrodes B3. In the chip resistor R2 of this structure, the current flows as dispersed into the plurality of resistor films B2. Thus, although the size of the chip resistor R2 is the same as that of the chip resistor A, the rated power of the chip resistor R2 is large.

However, in the chip resistor R2, the effective length (length of the portion which functions as a resistor element) of each of the resistor films B2 is shorter than that of the resistor film A2 of the chip resistor R1. Therefore, when the chip resistor R2 has the application of a surge voltage, its resistance tends to vary significantly (meaning that the resistor has a low surge resistance).

With reference to FIG. 11 of the present application, the chip resistor disclosed in the Patent Document 2 or 3 will be described below. The chip resistor R3 shown in the figure includes a substrate 31, electrodes 32 and 33 formed on the substrate and a resistor element 34. The left end 37 of the resistor element 34 is connected to a projection 35 of the electrode 32, whereas the right end 38 of the resistor element 34 is connected to a projection 36 of the electrode 33. The resistor element 34 extends in a meandering manner between the two electrodes 32 and 33. With this arrangement, the current path in the resistor element 34 is longer than that of a resistor element extending straight between the two electrodes. Thus, the surge resistance of the chip resistor R3 is enhanced.

Further, by connecting the opposite ends of the resistor element 34 to the projections 35 and 36 of the electrodes 32 and 33, a sufficient distance is secured between the inner edge 32*a* of the electrode 32 and the outer edge 34*a* of the resistor film 34 (or between the inner edge 33*a* of the electrode 33 and the outer edge 34*b* of the resistor film 34). Thus, in forming the resistor element 34 and the electrodes 32 and 33 on the substrate 31 by screen printing, the resistor element 34 and the electrodes 32, 33 are prevented from becoming too close to or coming into contact with each other (if the resistor element and the electrodes are too close, discharge occurs between them).

However, the structure shown in FIG. 11 has the following drawbacks.

As described above, the electrodes 32 and 33 (and the resistor element 34) can be formed by screen printing. Specifically, a screen for printing formed with holes corresponding to the shape of the electrodes 32 and 33 is prepared. Then, the screen is placed on the upper surface of the substrate 31. Then, material paste is applied from the upper surface side of the screen. Then, the material paste is loaded into the holes for electrode formation by using a squeegee. Finally, the screen is removed from the substrate 31. In this way, the electrodes 32 and 33 are formed.

In the above-described process, however, in removing the screen from the substrate 31, part of the material paste loaded in the holes may be removed from the substrate 31 together with the screen. In such a case, the projections 35 and 36 of the electrodes 32 and 33 cannot have a desired straight edge but have a round edge as indicated by the double-dashed lines $\alpha$ and $\beta$ in FIG. 11. As a result, the distance L0 between the two electrodes 32 and 33 is larger than the proper distance L, which causes the resistance of the chip resistor R3 to deviate from the desired value.

DISCLOSURE OF THE INVENTION

An object of the present invention is to provide a chip resistor capable of solving or alleviating the above-described problems.

According to a first aspect of the present invention, there is provided a chip resistor comprising: a chip substrate including an upper surface and a pair of side surfaces opposite to each other; a pair of terminal electrodes formed on the upper surface of the substrate to be spaced from each other; and a resistor film having a meandering shape and formed between the paired terminal electrodes. Each of the terminal electrodes includes an inner edge extending diagonally from one of the paired side surfaces toward the other one of the paired side surfaces of the chip substrate. A portion of the inner edge positioned close to the resistor film is electrically connected to a narrow portion formed integral with the resistor film, where the narrow portion extends outward from an end of the resistor film.

Preferably, the inner edges of the paired terminal electrodes may extend in parallel with each other.

According to a second aspect of the present invention, there is provided a method for manufacturing a chip resistor. The method comprises the steps of: forming a pair of terminal electrodes spaced from each other on an upper surface of a chip substrate; and forming a resistor film having a meandering shape between the paired terminal electrodes. In the terminal electrode formation step, each of the terminal electrodes is so formed to have an inner edge extending diagonally from one side surface of the chip substrate toward another side surface of the chip substrate. In the resistor film formation step, the resist or film is so formed to include a narrow portion extending integrally outward from an end thereof and electrically connected to a portion of the inner edge of a corresponding one of the terminal electrodes, where the portion mentioned above is close to the resistor film.

According to a third aspect of the present invention, there is provided a chip resistor comprising: a chip substrate including an upper surface and a pair of side surfaces opposite to each other; a pair of terminal electrodes for solder connection formed on the paired side surfaces; and a plurality of resistor films formed between the paired terminal electrodes. Each of the resistor films has a meandering shape extending from one of the paired terminal electrodes toward the other one of the paired terminal electrodes.

Preferably, the chip substrate may be in the form of an elongated rectangle, and each of the terminal electrodes may be formed respectively on an elongated side surface extending longitudinally of the chip substrate.

BEST MODE FOR CARRYING OUT THE INVENTION

Figure 1:
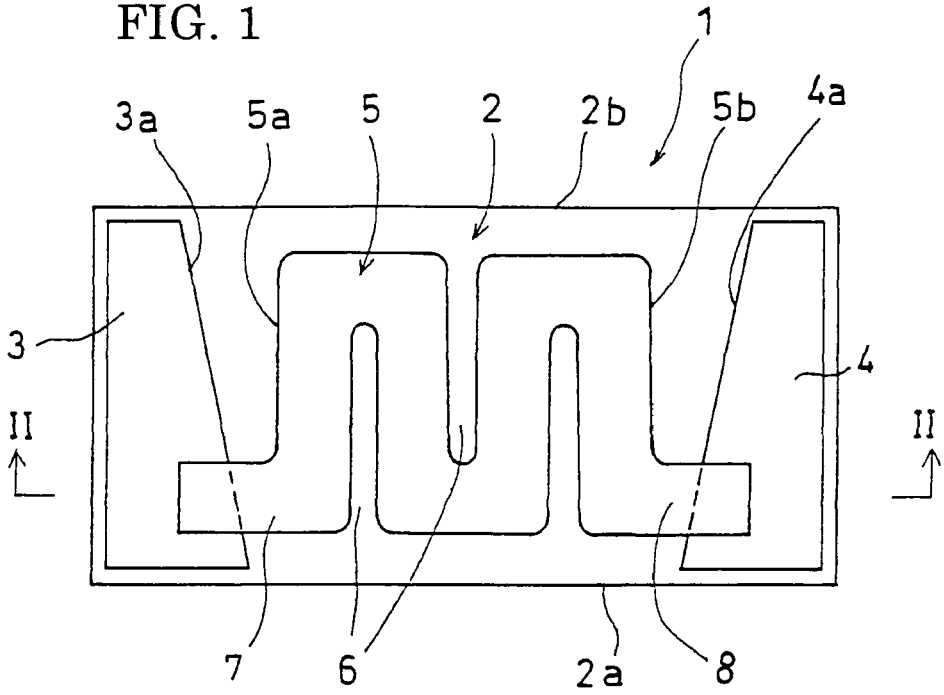
FIG. 1 is a plan view showing a chip resistor according to a first embodiment of the present invention.
Figure 2:
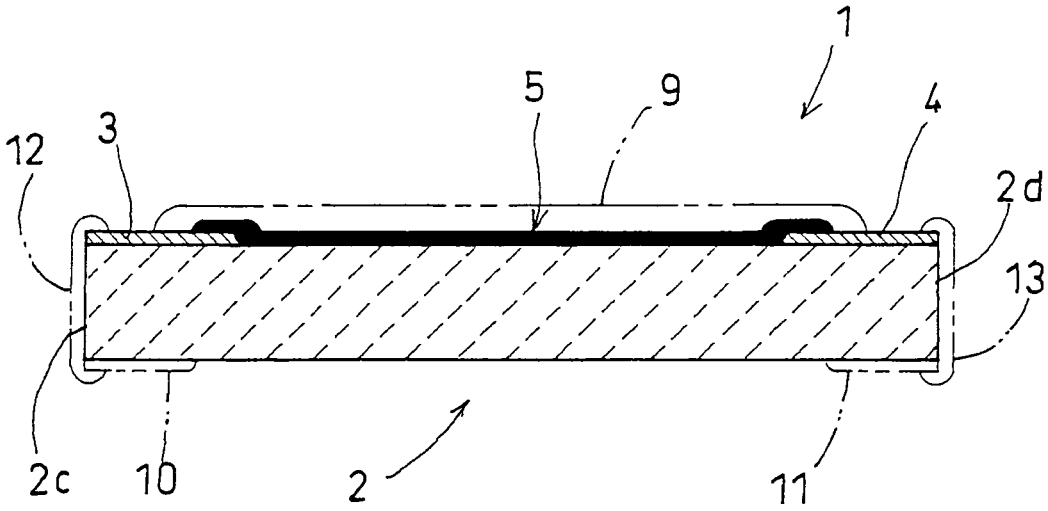
FIG. 2 is a sectional view taken along lines II-II in FIG. 1.

FIGS. 1 and 2 show a chip resistor 1 according to a first embodiment of the present invention. The chip resistor 1 includes a rectangular chip substrate 2 made of a ceramic material. A pair of terminal electrodes 3 and 4 are formed by screen printing at longitudinally opposite ends of upper surface of the chip substrate 2. A resistor film 5 formed by screen printing is provided between the paired terminal electrodes 3 and 4 on the upper surface of the chip substrate 2. The resistor film 5 is formed with a plurality of grooves 6 extending inward from a pair of longitudinally extending edges of the resistor film. The grooves 6 may be formed in the above-described screen printing process or by trimming after the screen printing. With the provision of the grooves 6, the resistor film 5 extends in a meandering manner between an end 5*a* and another end 5*b* thereof in the longitudinal direction.

As shown in FIG. 1, the terminal electrodes 3 and 4 include inclined inner edges 3*a* and 4*a*, respectively. Specifically, the terminal electrode 3 has a trapezoidal shape, and the upper base (the side adjacent to the side surface 2*b* of the substrate 2) is shorter than the lower base (the side adjacent to the side surface 2*a* of the substrate 2). The left side of the trapezoid (the side adjacent to the side surface 2*c* of the substrate 2 (see FIG. 2)) extends perpendicularly to both the upper base and the lower base and in parallel with the side surface 2*c* of the substrate 2. The right side of the trapezoid, i.e., the inner edge 3*a* of the terminal electrode 3 is not parallel with the side surface 2*c* of the substrate 2. As shown in FIG. 1, the inner edge 3*a* extends "diagonally outward" from the side surface 2*a* toward the side surface 2*b* of the chip substrate 2. (That is, the inner edge 3*a* is so inclined as to extend away from the center of the substrate 2 as progressing from the side surface 2*a* toward the side surface 2*b* of the chip substrate 2.) Similarly, the inner edge 4*a* of the terminal electrode 4 extends diagonally outward from the side surface 2*a* toward the side surface 2*b* of the chip substrate 2. The ends 5*a* and 5*b* of the resistor film 5 are respectively formed integral with narrow portions 7 and 8 extending outward. Each of the narrow portions 7 and 8 is laminated on and electrically connected to the inclined inner edge 3*a*, 4*a* of the corresponding terminal electrode 3, 4 at a portion closer to the resistor film 5, i.e., the portion adjacent to the longitudinal side surface 2*a* of the chip substrate 2.

Referring to FIG. 2, indicated by the reference sign 9 is a cover coat covering the entirety of the resistor film 5. Indicated by the reference signs 10 and 11 are terminal electrodes formed on the reverse surface of the chip substrate 2. Indicated by the reference signs 12 and 13 are side surface terminal electrodes formed on the side surfaces 2*c* and 2*d* of the chip substrate 2 to electrically connect the terminal electrodes 3 and 4 on the upper surface side to the terminal electrodes 10 and 11 on the lower surface side.

In the above-described structure, as noted above, the inner edges 3*a* and 4*a* of the terminal electrodes 3 and 4 are inclined outwardly from the side surface 2*a* toward the side surface 2*b* of the chip substrate 2. The narrow portions 7 and 8 extending integrally outward from the opposite ends 5*a* and 5*b* of the resistor film 5 are laminated on and electrically connected to portions of the inclined inner edge 3*a* and 4*a* which are close to the resistor film 5. With this arrangement, even when pattern misalignment between the resistor film 5 and the terminal electrodes 3, 4 in the longitudinal direction of the resistor film 5 occurs in screen printing the terminal electrodes and the resistor film, a distance sufficient to allow the pattern misalignment is defined between the inner edges 3*a*, 4*a* of the terminal electrodes 3, 4 and the ends 5*a*, 5*b* of the resistor film 5.

The above-described shape of the terminal electrodes 3 and 4 can be provided just by inclining the inner edges 3*a* and 4*a* outwardly. Thus, in forming the terminal electrodes 3 and 4 by screen printing, the inner edges 3*a* and 4*a* are properly formed into a shape extremely close to the predetermined shape. Thus, the effective length L of the resistor film 5 is prevented from varying, so that the resistance of the resistor film 5 is prevented from deviating from a desired value.

Figure 3:
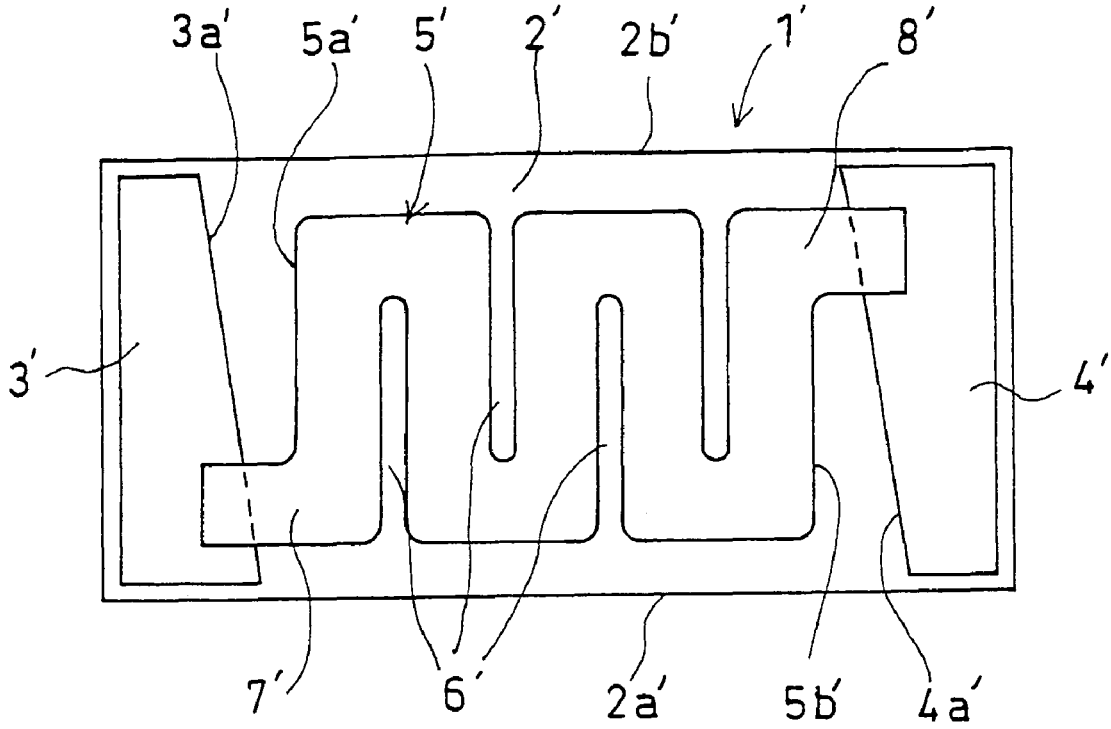
FIG. 3 is a plan view showing a chip resistor according to a second embodiment of the present invention.

FIG. 3 shows a chip resistor 1' according to a second embodiment of the present invention.

The chip resistor 1' includes a chip substrate 2' in the form of an elongated rectangle made of a ceramic material, terminal electrodes 3' and 4' formed by screen printing at longitudinally opposite ends of the upper surface of the chip substrate 2', and a resistor film 5' formed by screen printing between the paired terminal electrodes 3' and 4' on the upper surface of the chip substrate 2' to extend longitudinally of the chip substrate. The resistor film 5' is formed with a plurality of grooves 6' extending inward from the longitudinal edges thereof, which may be formed in the screen printing process or by trimming after the screen printing. With the provision of the grooves, the resistor film 5 extends in a meandering manner between an end 5*a*' and another end 5*b*' thereof in the longitudinal direction.

The terminal electrode 3' has an inner edge 3*a*' which is inclined outwardly from a longitudinal side surface 2*a*' toward a longitudinal side surface 2*b*' of the chip substrate 2'. The terminal electrode 4' has an inner edge 4*a*' which is inclined outwardly from the side surface 2*b*' toward the side surface 2*a*' of the chip substrate 2'.

The inclined inner edge 3*a*' of the terminal electrode 3' and the inclined inner edge 4*a*' of the terminal electrode 4' extend in parallel with or generally in parallel with each other.

The end 5*a*' of the resistor film 5' is formed with a narrow portion 7' extending integrally outward therefrom. The narrow portion is laminated on and electrically connected to the inclined inner edge 3*a*' of the terminal electrode 3' at a portion close to the resistor film 5', i.e., the portion adjacent to the longitudinal side surface 2*a*' of the chip substrate 2'. Similarly, the end 5*b*' of the resistor film 5' is formed with a narrow portion 8' extending integrally outward therefrom. The narrow portion is laminated on and electrically connected to the inclined inner edge 4*a*' of the terminal electrode 4' at a portion close to the resistor film 5', i.e., the portion adjacent to the longitudinal side surface 2*b*' of the chip substrate 2'.

With this arrangement, as in the first embodiment, even when some pattern misalignment between the resistor film 5' and the terminal electrodes 3', 4' in the longitudinal direction of the resistor film 5' occurs in screen printing of the terminal electrodes and the resistor film, a distance sufficient to allow the pattern misalignment can be provided between the inner edges 3*a*', 4*a*' of the terminal electrodes 3', 4, and the ends 5*a*', 5*b*' of the resistor film 5 owing to the outward inclination of the inner edges 3*a*', 4*a*' of the terminal electrodes 3', 4'.

The above-described shape of the terminal electrodes 3' and 4' can be provided just by inclining the inner edges 3*a*' and 4*a*' outwardly. In forming the terminal electrodes 3' and 4' by screen printing, the inner edges 3*a*' and 4*a*' are properly formed into a shape extremely close to the predetermined shape. Thus, the effective length L' of the resistor film 5' is prevented from varying.

As noted above, the inclined inner edge 3*a*' of the terminal electrode 3' and the inclined inner edge 4*a*' of the terminal electrode 4' extend in parallel with or generally in parallel with each other. Thus, even when pattern misalignment between the resistor film 5' and the terminal electrodes 3', 4' in a direction perpendicular to the longitudinal direction of the resistor film 5' occurs in screen printing the terminal electrodes and the resistor film, the effective length L' of the resistor film 5' does not vary. Thus, the resistance of the resistor film 5' is reliably prevented from varying.

Figure 4:
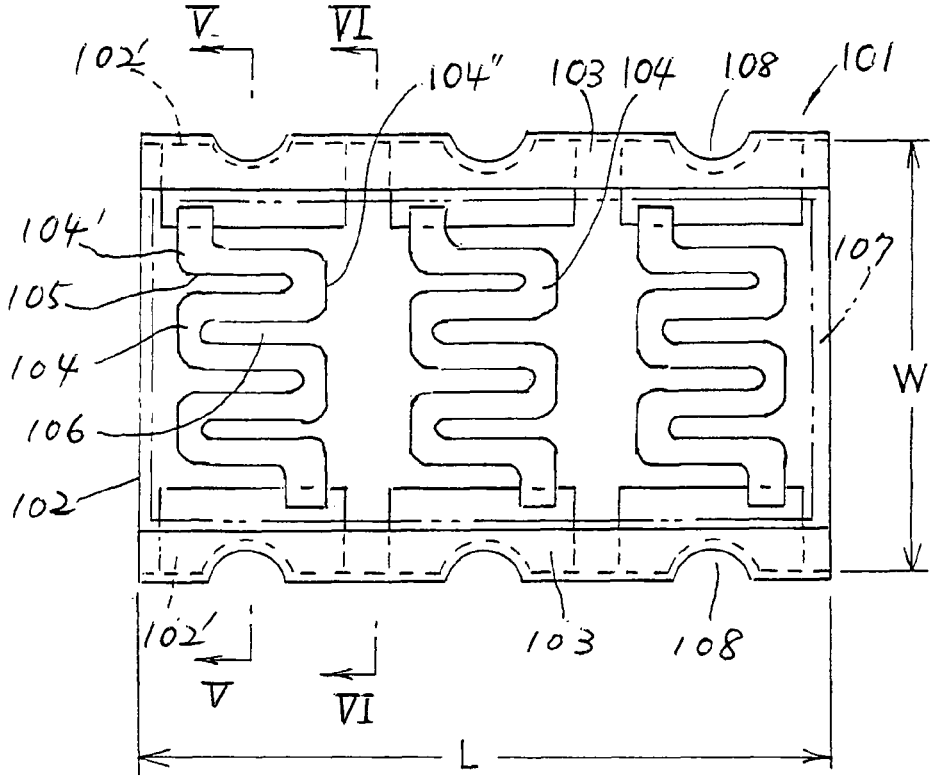
FIG. 4 is a plan view showing a chip resistor according to a third embodiment of the present invention.
Figure 5:
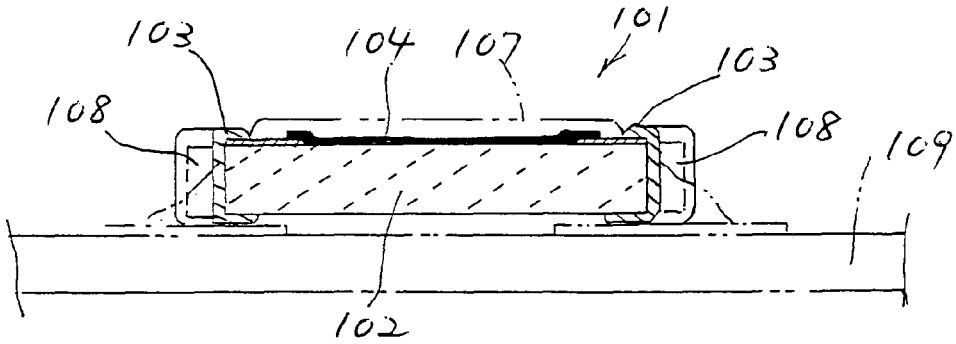
FIG. 5 is a sectional view taken along lines V-V in FIG. 4.
Figure 6:
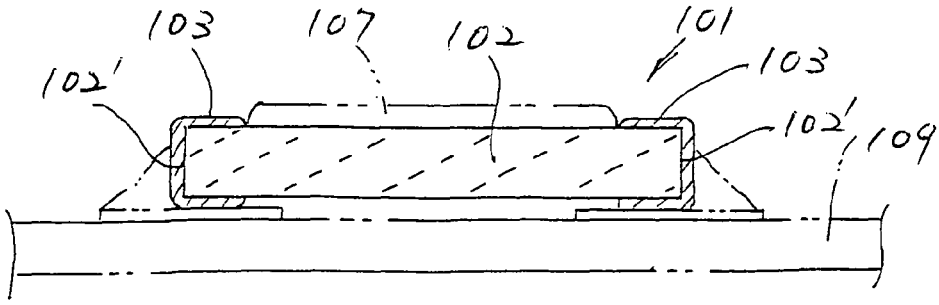
FIG. 6 is a sectional view taken along lines VI-VI in FIG. 4.

FIGS. 4-6 show a chip resistor 101 according to a third embodiment of the present invention.

The chip resistor 101 includes an insulating substrate 102 made of a heat-resistant insulating material such as a ceramic material. The insulating substrate 102 is in the form of an elongated rectangle having a length L and a width W.

Terminal electrodes 103 for solder connection are provided on a pair of longitudinally-extending side surfaces 102' of the insulating substrate 102 to extend along the side surfaces 102'.

A plurality of resistor films 104 (three resistor films in the example shown in the figure) are provided between the terminal electrodes 103 on the upper surface of the insulating substrate 102. The resistor films are arranged, in parallel with each other and spaced from each other in the longitudinal direction of the insulating substrate 102. Each of the resistor films 104 has opposite ends electrically connected to the terminal electrodes 103.

Each of the resistor films 104 is alternately formed with a plurality of grooves 105 (two in the figure) extending inward from the longitudinal edge 104' of the resistor film and a plurality of grooves 106 (two in the figure) extending inward from the other longitudinal edge 104" of the resistor film. Thus, the resistor film has a meandering shape.

A cover coat covering the entirety of the resistor films 104 is provided on the upper surface of the insulating substrate 102.

The meandering shape of each of the resistor films 104 may be provided by forming the grooves 105 and 106 in screen printing the resistor film 104 or by forming part or entirety of the grooves 105 and 106 by trimming by e.g. laser beam irradiation after the screen printing.

In the above-described structure, the power applied to the terminal electrodes 103 is dispersed into each of the resistor films 104. Thus, the chip resistor is applicable to large electric power. Since each of the resistor films 104 has a meandering shape, the current path is long. Thus, the rate of change of the resistance in the case where a surge voltage is applied is small. Thus, the surge resistance is enhanced.

Figure 7:
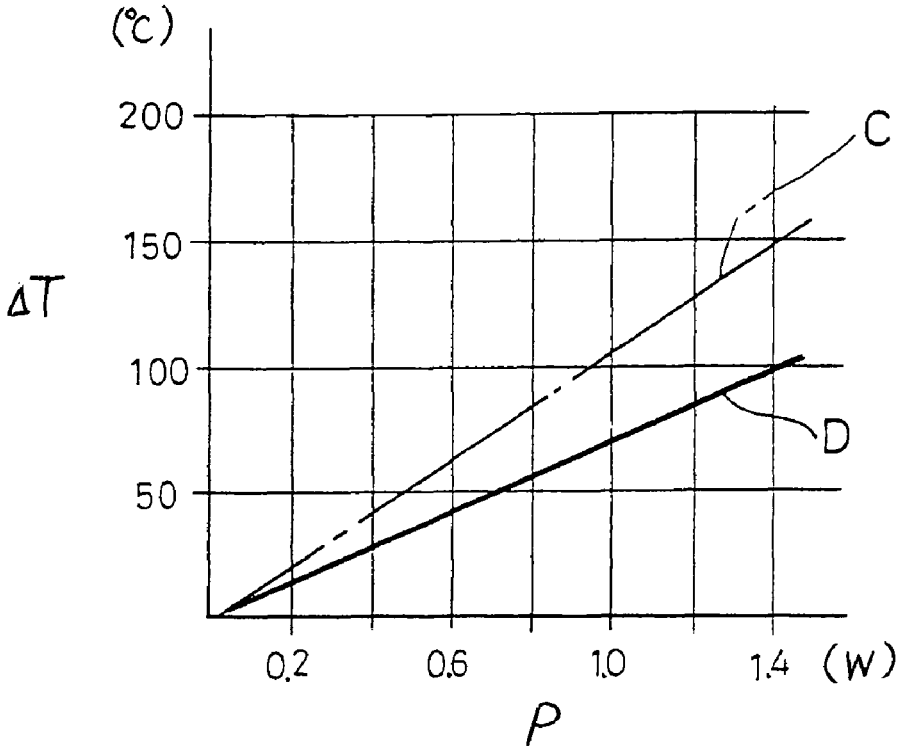
FIG. 7 shows the temperature rise at the surface of a resistor film.
Figure 8:
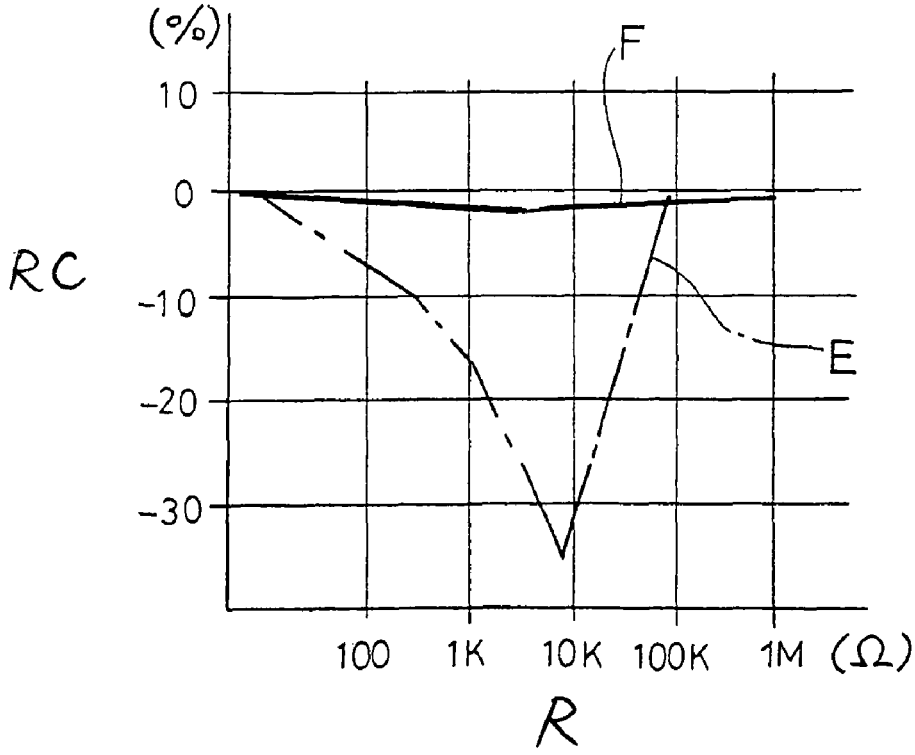
FIG. 8 shows the results of an electrostatic breakdown test.
Figure 9:
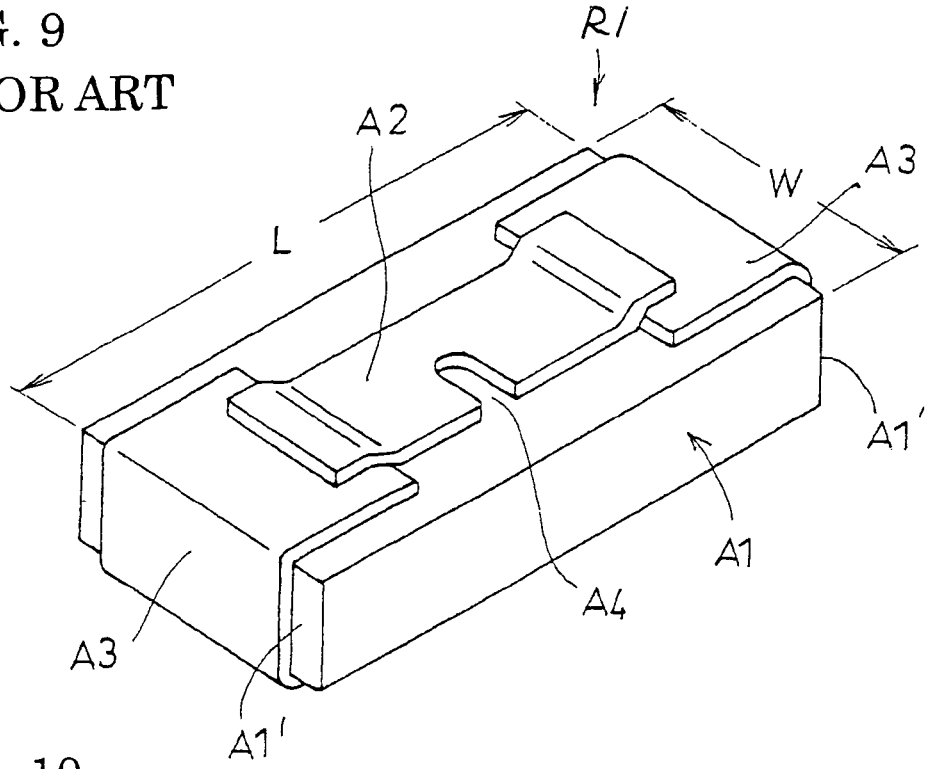
FIG. 9 PRIOR ART
FIG. 9 is a perspective view showing a conventional chip resistor.
Figure 10:
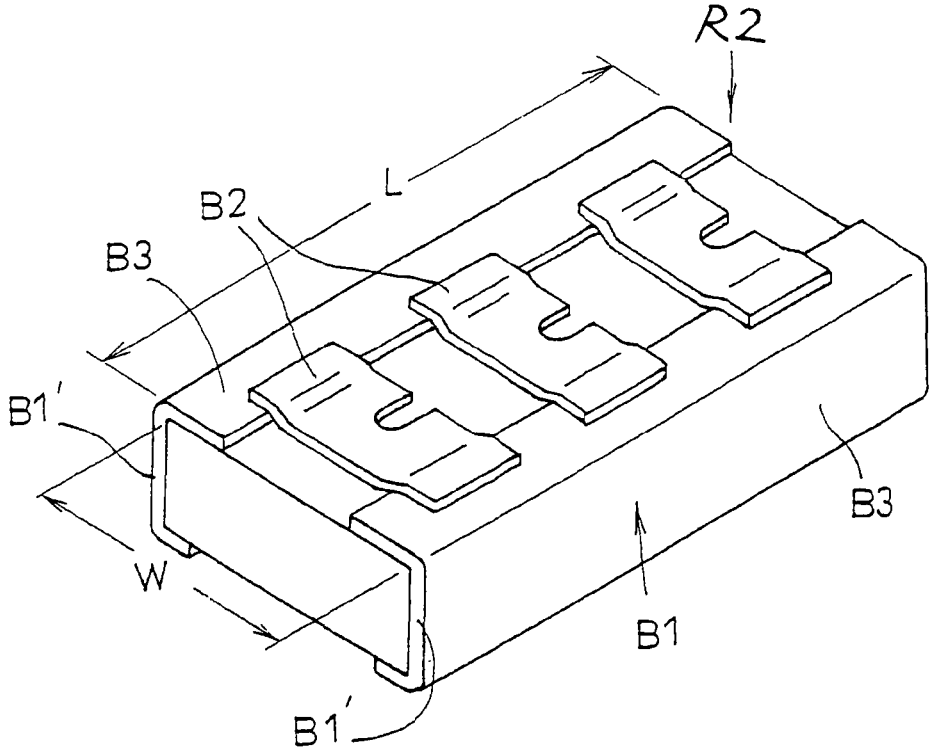
FIG. 10 is a perspective view showing a comparative example for the present invention.
Figure 11:
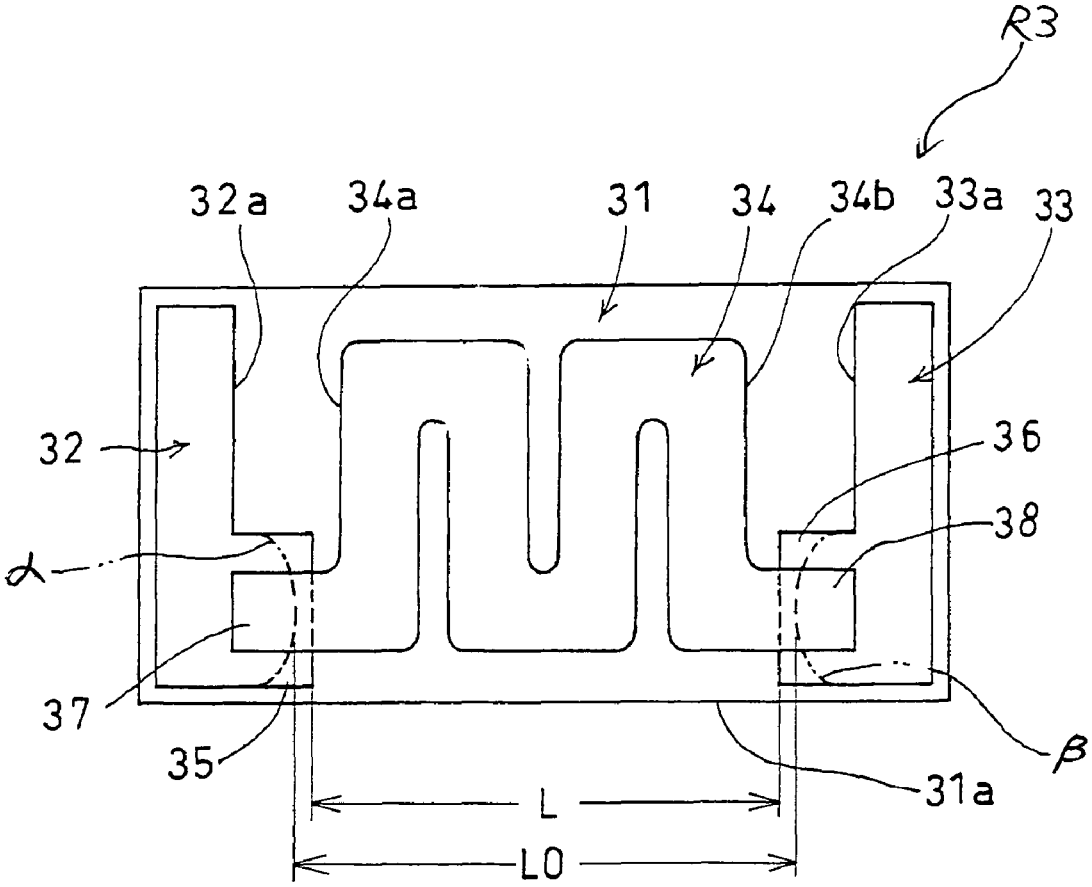
FIG. 11 PRIOR ART
FIG. 11 is a perspective view showing another conventional chip resistor.

FIGS. 7 and 8 show the results of experiments carried out to compare the performance of the chip resistor 101 according to the present invention, the conventional chip resistor R1 shown in FIG. 9 and the chip resistor R2 shown in FIG. 10 as a comparative example, all of which had an elongated rectangular shape of a same size (with a same length L and a same width W).

Specifically, FIG. 7 shows the relationship between the power (P) applied to the terminal electrodes and the temperature rise (ΔT) at the surface of the resistor film. As indicated by the single-dashed line C, the temperature rise at the conventional chip resistor R1 is relatively large. On the other hand, as indicated by the solid line D, the temperature rise at the chip resistor 101 according to the present invention (and the chip resistor R2 as the comparative example) is considerably small.

FIG. 8 shows the results of electrostatic breakdown test (evaluation of surge resistance). In the figure, the abscissa indicates the resistance (R) of the chip resistor, whereas the ordinate indicates the rate of change (RC) of the resistance. As indicated by the single-dashed line E, the resistance change of the chip resistor R2 as a comparative example is considerably large. On the other hand, as indicated by the solid line F, the resistance change of the chip resistor 101 according to the present invention is considerably small.

In this embodiment, each of the longitudinal side surfaces 102' of the insulating substrate 102 is formed with at least one recess 108, and the terminal electrode 103 is formed also on the inner surface of the recess 108. With this arrangement, in soldering the chip resistor onto e.g. a printed board 109, the soldering strength can be enhanced by forming a solder fillet bulging into the recess 108.

The invention claimed is:

1. A chip resistor comprising:

a chip substrate including an upper surface and a pair of side surfaces opposite to each other;

a pair of terminal electrodes formed on the upper surface of the substrate in a mutually separate state; and a meandering resistor film formed between the paired terminal electrodes;

wherein each of the terminal electrodes includes an inner edge extending diagonally from one of the side surfaces toward the other of the side surfaces of the chip substrate, the inner edge including a portion which is closer to the resistor film and which is electrically connected to a narrow portion formed integral with the resistor film, the narrow portion extending outward from an end of the resistor film.

2. The chip resistor according to claim 1, wherein the inner edges of the paired terminal electrodes extend in parallel with each other.

3. A method for manufacturing a chip resistor, the method comprising the steps of:

forming a pair of terminal electrodes spaced from each other on an upper surface of a chip substrate; and forming a meandering resistor film between the paired terminal electrodes;

wherein, in the step of forming the terminal electrodes, each of the terminal electrodes is so formed as to have an inner edge extending diagonally from a side surface of the chip substrate toward another side surface of the chip substrate, wherein, in the step of forming the resistor film, the resistor film is so formed as to integrally include a narrow portion extending outward from an end of the resistor film, the narrow portion being electrically connected to the inner edge of one of the terminal electrodes at a portion closer to the resistor film.

* * * * *